US008916317B2

(12) United States Patent
Iftime et al.

(10) Patent No.: US 8,916,317 B2
(45) Date of Patent: Dec. 23, 2014

(54) TONER PROCESSES

(75) Inventors: Gabriel Iftime, Mississauga (CA); Jordan H. Wosnick, Toronto (CA); Eric Rotberg, Toronto (CA); Cuong Vong, Hamilton (CA); Edward Graham Zwartz, Mississauga (CA); Richard P. N. Veregin, Mississauga (CA); Karen Ann Moffat, Brantford (CA); Peter M. Kazmaier, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 298 days.

(21) Appl. No.: 12/729,617

(22) Filed: Mar. 23, 2010

(65) Prior Publication Data

US 2011/0143278 A1 Jun. 16, 2011

Related U.S. Application Data

(63) Continuation-in-part of application No. 12/634,979, filed on Dec. 10, 2009.

(51) Int. Cl.

| | |
|---|---|
| ***G03G 13/01*** | (2006.01) |
| ***G03G 9/09*** | (2006.01) |
| ***G03G 9/087*** | (2006.01) |

(52) U.S. Cl.

CPC ..... *G03G 9/08795* (2013.01); *G03G 9/08782* (2013.01); *G03G 9/08797* (2013.01); *G03G 9/09* (2013.01); *G03G 9/0908* (2013.01); *G03G 9/0914* (2013.01); *G03G 9/092* (2013.01); *G03G 9/0922* (2013.01); *G03G 9/0926* (2013.01)

USPC ..... 430/45.51; 430/45.1; 430/107.1

(58) Field of Classification Search

USPC ..... 430/42.1, 43.1, 45.1, 45.51, 45.4, 430/107.1, 137.1

See application file for complete search history.

(56) References Cited

U.S. PATENT DOCUMENTS

| | | | | |
|---|---|---|---|---|
| 3,590,000 | A | 6/1971 | Palermiti et al. | |
| 3,800,588 | A | 4/1974 | Larson et al. | |
| 3,847,604 | A | 11/1974 | Hagenbach et al. | |
| 4,295,990 | A | 10/1981 | Verbeek et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,149,138 | A * | 9/1992 | Zemsky | 283/70 |
| 5,236,629 | A | 8/1993 | Mahabadi et al. | |
| 5,290,654 | A | 3/1994 | Sacripante et al. | |
| 5,302,486 | A | 4/1994 | Patel et al. | |
| 5,330,874 | A | 7/1994 | Mahabadi et al. | |
| 5,435,937 | A | 7/1995 | Bell et al. | |
| 5,554,480 | A | 9/1996 | Patel et al. | |
| 5,714,291 | A * | 2/1998 | Marinello et al. | 430/108.1 |
| 6,063,827 | A | 5/2000 | Sacripante et al. | |
| 6,214,507 | B1 | 4/2001 | Sokol et al. | |
| 6,589,761 | B1 * | 7/2003 | Freadman et al. | 435/29 |
| 6,593,049 | B1 | 7/2003 | Veregin et al. | |
| 6,664,017 | B1 * | 12/2003 | Patel et al. | 430/123.57 |
| 6,673,500 | B1 | 1/2004 | Patel et al. | |
| 6,756,176 | B2 | 6/2004 | Stegamat et al. | |
| 6,830,860 | B2 | 12/2004 | Sacripante et al. | |
| 6,890,695 | B2 * | 5/2005 | Shirai et al. | 430/109.4 |
| 2006/0222991 | A1 | 10/2006 | Sacripante et al. | |
| 2008/0110995 | A1 * | 5/2008 | Iftime et al. | 235/491 |
| 2009/0214972 | A1 * | 8/2009 | Wosnick et al. | 430/108.2 |

FOREIGN PATENT DOCUMENTS

| | | | |
|---|---|---|---|
| JP | 2002351216 | | 12/2002 |
| JP | 2007-017719 | A * | 1/2007 |

OTHER PUBLICATIONS

Japanese Patent Office machine-assisted translation of JP 2007-17719 (pub. Jan. 2007).*

RCA Electro-Optics Handbook, Technical Series EOH-11, RCA Corporation, PA (1974), pp. 13-14.*

* cited by examiner

*Primary Examiner* — Janis L Dote

(74) *Attorney, Agent, or Firm* — MDIP LLC

(57) ABSTRACT

The present disclosure provides toners and processes for making said toners. In embodiments, the toners are invisible when viewed under natural light, but possess a fluorescent agent that renders them visible when exposed to UV light of a specific wavelength. In other embodiments the toners have a color under natural light, and a different color when exposed to UV light.

11 Claims, 2 Drawing Sheets

TONER PROCESSES

RELATED APPLICATIONS

This application is a continuation in part of co-pending U.S. patent application Ser. No. 12/634,979, the disclosure of which is hereby incorporated by reference in its entirety.

BACKGROUND

The present disclosure relates to toners suitable for electrophotographic apparatuses and processes for making such toners.

Toner blends containing crystalline or semi-crystalline polyester resins with an amorphous resin have been recently shown to provide very desirable ultra low melt fusing, which is important for both high-speed printing and lower fuser power consumption. These types of toners containing crystalline polyesters have been demonstrated suitable for both emulsion aggregation (EA) toners, and in conventional jetted toners. Combinations of amorphous and crystalline polyesters may provide toners with relatively low-melting point characteristics (sometimes referred to as low-melt, ultra low melt or ULM), which allows for more energy efficient and faster printing.

Fluorescent inks and dyes may be used as an authenticating feature in the document security industry. Secure documents, for example documents that are difficult to forge, may be conventionally created using inks that include fluorescent agents either alone or in combination with ordinary inks and/or pigments. Features printed using fluorescent inks are usually invisible under visible light, due to the colorless nature of the security inks or due to masking by other colorants in the document. Under proper illumination, however, the fluorescent features of the document are revealed in the form of a bright emission by the fluorescent dyes in the visible spectrum. For example, certain bank notes utilize visible features, such as holographic patches, microprinting and microtextures to conceal additional fluorescent threads and/or multi-colored emblems embedded in the bank note, which are only reveled under specific light frequencies. These features provide an increased level of security against counterfeiters by making the copying process of such a document more difficult.

Although fluorescent inks are available as described above, the use of toners for printing security features is somewhat limited. For example, U.S. Pat. No. 5,554,480, the disclosure of which is hereby incorporated by reference in its entirety, describes the use of ordinary organic fluorescent dyes which are applied via non-electrophotographic methods (flexo printing, inkjet, and the like). Furthermore, available fluorescent toners may appear colored under visible light, which defeats their usefulness as hidden security features.

Improved methods for producing toners which are suitable for use in creating security documents remain desirable.

SUMMARY

The present disclosure provides processes for making toners and the toners produced thereby. In embodiments, a process of the present disclosure includes forming a first toner composition including at least one amorphous resin and at least one crystalline resin, an optional colorant, and an optional wax with at least one component capable of emitting light upon exposure to ultraviolet light at a wavelength of from about 10 nm to about 400 nm; forming at least one additional toner composition including at least one amorphous resin and at least one crystalline resin, an optional colorant, and an optional wax with at least one component capable of emitting light upon exposure to ultraviolet light at a wavelength of from about 10 nm to about 400 nm; applying the first toner and the at least one additional toner to a substrate; and exposing the first toner and the at least one additional toner to light at a wavelength of from about 10 nm to about 400 nm, wherein exposing the first toner and the at least one additional toner to light at a wavelength of from about 10 nm to about 400 nm causes the first toner to emit a first color and the at least one additional toner to emit a color different from the first color. In embodiments, the at least one additional toner comprises from one to about 5 toners.

In embodiments, a process of the present disclosure includes forming a first toner composition including at least one amorphous resin and at least one crystalline resin, an optional colorant, and an optional wax with at least one component capable of emitting a red color upon exposure to ultraviolet light at a wavelength of from about 10 nm to about 400 nm; forming a second toner composition including at least one amorphous resin and at least one crystalline resin, an optional colorant, and an optional wax with at least one component capable of emitting a green color upon exposure to ultraviolet light at a wavelength of from about 10 nm to about 400 nm; forming a third toner composition including at least one amorphous resin and at least one crystalline resin, an optional colorant, and an optional wax with at least one component capable of emitting a blue color upon exposure to ultraviolet light at a wavelength of from about 10 nm to about 400 nm; applying the first toner, the second toner and the third toner to a substrate; and exposing the first toner, the second toner and the third toner to light at a wavelength of from about 10 nm to about 400 nm, wherein exposing the first toner, the second toner and the third toner to light at a wavelength of from about 10 nm to about 400 nm causes the first toner to emit a red color, the second toner to emit a green color, and the third toner to emit a blue color.

In embodiments, the amount of the first toner, the second toner, and the third toner applied to the substrate may be adjusted to produce a desired color upon exposure to light at a wavelength of from about 10 nm to about 400 nm.

In other embodiments, a process of the present disclosure includes forming a first toner composition including at least one amorphous resin and at least one crystalline resin, an optional colorant, and an optional wax with at least one component capable of emitting a red color upon exposure to ultraviolet light at a wavelength of from about 10 nm to about 400 nm; forming a second toner composition including at least one amorphous resin and at least one crystalline resin, an optional colorant, and an optional wax with at least one component capable of emitting a green color upon exposure to ultraviolet light at a wavelength of from about 10 nm to about 400 nm; forming a third toner composition including at least one amorphous resin and at least one crystalline resin, an optional colorant, and an optional wax with at least one component capable of emitting a blue color upon exposure to ultraviolet light at a wavelength of from about 10 nm to about 400 nm; applying the first toner, the second toner and the third toner to a substrate; and exposing the first toner, the second toner and the third toner to light at a wavelength of from about 10 nm to about 400 nm, wherein exposing the first toner, the second toner and the third toner to light at a wavelength of from about 10 nm to about 400 nm causes the first toner to emit a red color, the second toner to emit a green color, and the third toner to emit a blue color, and wherein the at least one component capable of emitting light upon exposure to ultraviolet light is 4,4'-bis(styryl)biphenyl,2-(4-phenylstilben-4-yl)-6-butylbenzoxazole, 2-(2-hydroxyphenyl)benzothiazole, β-methyl umbelliferone, 4-methyl-7-dimethylarninocoumarin, 4-methyl-7-amninocoumarin, N-methyl-4-methoxy-1,8-naphthalimide, 9,10-bis(phenethynyl)anthracene, 5,12-bis(phenethynyl)naphthacene, 9,10-diphenyl anthracene and its derivatives, N-salicylidene-4-dimethylaminoaniline, 2-(2-hydroxyphenyl)benzimidazole, 2-(2-hydroxyphenyl)benzoxazole, lanthanide coordination complexes, and combinations thereof.

DESCRIPTION OF THE DRAWINGS

Various embodiments of the present disclosure will be described herein below with reference to the figure wherein.

DETAILED DESCRIPTION

Figure 1:
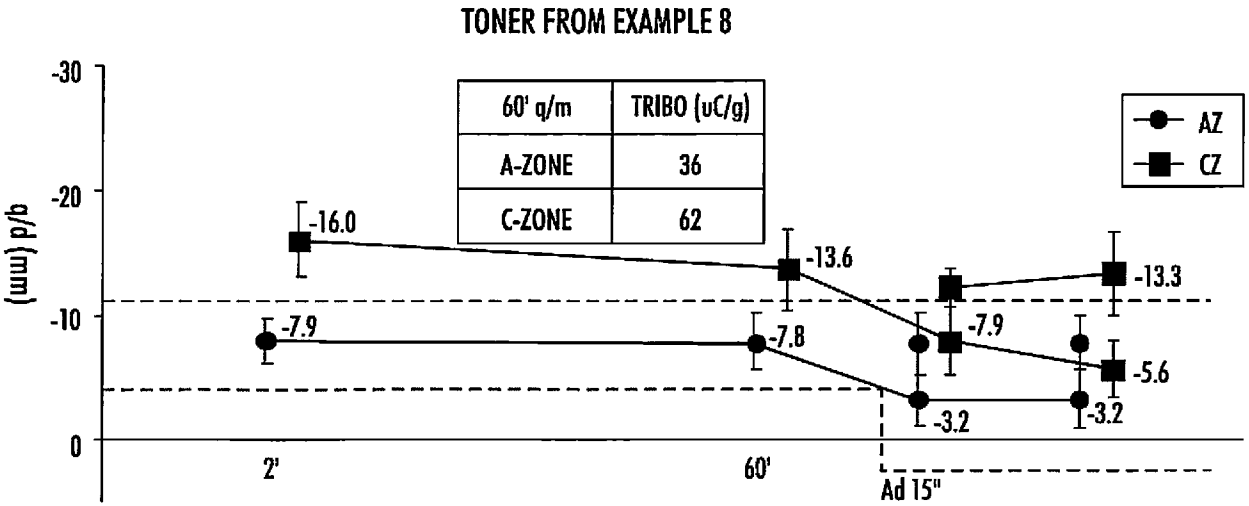
FIG. 1 is a graph showing charge characteristics of a toner of the present disclosure in both A-zone and C-zone.

The present disclosure provides ultra low melt EA toner compositions and processes for making these toners. In embodiments, images from the toners of the present disclosure are invisible under normal viewing light conditions, but are detectable under ultraviolet (UV) light. In embodiments, the mechanism for detection of the images is the emission of UV light by the otherwise essentially invisible toner. The emission of UV light is caused, at least in part, by the presence of suitable fluorescent agents in the toner of the present disclosure.

Toners of the present disclosure may be prepared from a resin latex in combination with a fluorescent agent and optionally a wax. While the resin latex may be prepared by any method within the purview of those skilled in the art, in embodiments the resin latex may be prepared by solvent flashing methods, as well as emulsion polymerization methods, including semi-continuous emulsion polymerization and the toner may include emulsion aggregation toners. Emulsion aggregation involves aggregation of both submicron latex and pigment particles into toner size particles, where the growth in particle size is, for example, in embodiments from about 0.1 micron to about 15 microns.

Toners of the present disclosure may have many uses including, in embodiments, security printing. Toners of the present disclosure may be clear, and may be designed to match the gloss of the substrate medium, e.g., paper, to which they are applied. The toners of the present disclosure are thus invisible to the naked eye under normal lighting conditions, but possess organic and/or inorganic materials which emit UV light, producing an image upon exposure to UV light.

Resins

Toners of the present disclosure may include any latex resin suitable for use in forming a toner. Such resins, in turn, may be made of any suitable monomer. Suitable monomers useful in forming the resin include, but are not limited to, acrylonitriles, diols, diacids, diamines, diesters, diisocyanates, combinations thereof, and the like. Any monomer employed may be selected depending upon the particular polymer to be utilized.

In embodiments, the polymer utilized to form the resin may be a polyester resin. Suitable polyester resins include, for example, sulfonated, non-sulfonated, crystalline, amorphous, combinations thereof, and the like. The polyester resins may be linear, branched, combinations thereof, and the like. Polyester resins may include, in embodiments, those resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, the resin may be a polyester resin formed by reacting a diol with a diacid or diester in the presence of an optional catalyst. For forming a crystalline polyester, suitable organic diols include aliphatic diols having from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), poly(decylene-decanoate), poly-(ethylene-decanoate), poly-(ethylene-dodecanoate), poly(nonylene-sebacate), poly (nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), and combinations thereof. The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

In embodiments, an unsaturated, amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof. In embodiments, the amorphous resin utilized in the core may be linear.

In embodiments, a suitable amorphous polyester resin may be a poly(propoxylated bisphenol A co-fumarate) resin having the following formula (I):

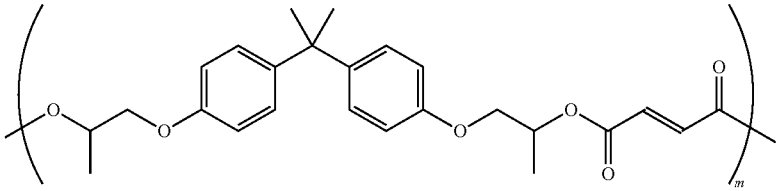

(I)

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana SIA Industrias Quimicas, Sao Paulo, Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, a suitable amorphous resin utilized in a toner of the present disclosure may have a molecular weight of from about 10,000 to about 100,000, in embodiments from about 15,000 to about 30,000.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

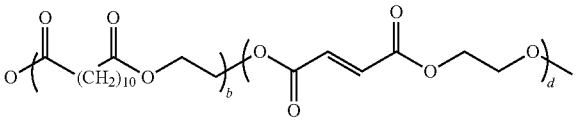

wherein b is from about 5 to about 2000 and d is from about 5 to about 2000.

In embodiments, a suitable crystalline resin utilized in a toner of the present disclosure may have a molecular weight of from about 10,000 to about 100,000, in embodiments from about 15,000 to about 30,000.

One, two, or more resins may be used in forming a toner. In embodiments where two or more resins are used, the resins may be in any suitable ratio (e.g., weight ratio) such as, for instance, from about 1% (crystalline resin)/99% (amorphous resin) to about 99% (crystalline resin)/1% (amorphous resin), in embodiments from about 10% (crystalline resin)/90% (amorphous resin) to about 90% (crystalline resin)/10% (amorphous resin). In some embodiments, the weight ratio of the resins may be from about 99% to about 90% of the amorphous resin, to from about 1% to about 10% of the crystalline resin.

In embodiments, a suitable toner of the present disclosure may include 2 amorphous polyester resins and a crystalline polyester resin. The weight ratio of the three resins may be from about 29% of a first high molecular weight amorphous resin/69% second low molecular weight amorphous resin/2% crystalline resin, to about 60% first high molecular weight amorphous resin/20% second low molecular weight amorphous resin/20% crystalline resin.

Where 2 amorphous polyester resins are utilized, one of the amorphous polyester resins may be of high molecular weight, with the second amorphous polyester resin being of low molecular weight. As used herein, a high molecular weight amorphous resin may have, for example, a weight average molecular weight ($M_w$) greater than 55,000, for example, from about 55,000 to about 150,000, in embodiments from about 50,000 to about 100,000, in other embodiments from about 63,000 to about 94,000, in other embodiments from about 68,000 to about 85,000, as determined by gel permeation chromatography (GPC), using polystyrene standard. The high molecular weight amorphous polyester resins may have an acid value of from about 8 to about 20 mg KOH/grams, in embodiments from about 9 to about 16 mg KOH/grams, and in other embodiments from about 11 to about 15 mg KOH/grams. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in other embodiments from about 115° C. to about 121° C.

As used herein, a low molecular weight amorphous polyester resin has, for example, a weight average molecular weight ($M_w$) of 50,000 or less, for example, from about 2,000 to about 50,000, in embodiments from about 3,000 to about 40,000, in embodiments from about 10,000 to about 30,000, and in other embodiments from about 18,000 to about 21,000, as determined by GPC using polystyrene standards. The low molecular weight amorphous polyester resins may have an acid value of from about 8 to about 20 mg KOH/grams, in embodiments from about 9 to about 16 mg KOH/grams, in other embodiments from about 10 to about 14 mg KOH/grams. The low molecular weight amorphous resins can possess various onset glass transition temperatures (Tg) of, for example, from about 40° C. to about 80° C., in embodiments from about 50° C. to about 70° C., in other embodiments from about 58° C. to about 62° C., as measured by differential scanning calorimetry (DSC).

As noted above, in embodiments, the resin may be formed by emulsion aggregation methods. Utilizing such methods, the resin may be present in a resin emulsion, which may then be combined with other components and additives to form a toner of the present disclosure.

Surfactants

In embodiments, resins, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Toner

The resin of the resin emulsions described above, in embodiments a polyester resin, may be utilized to form toner compositions. Such toner compositions may include optional colorants, waxes, and other additives. Toners may be formed utilizing any method within the purview of those skilled in the art including, but not limited to, emulsion aggregation methods.

Fluorescent Agents

In accordance with the present disclosure, the toners produced herein may be colorless, i.e., prints made with the toner on suitable selected paper substrates are not visible under normal viewing conditions, or they may be colored, i.e., prints made with the toner are visible under normal viewing conditions. Thus, in some embodiments, by using fluorescent toners instead of colored toners, full color fluorescent images that are visible under UV light, but appear clear under normal light, can be generated. Alternatively, by using fluorescent toners in addition to colored toners utilized for full color printing, or by combining fluorescent pigments into one or more of the color toners, full color images that reveal additional fluorescent features and/or different fluorescent colors under UV light can be created.

Thus, whether colorless or colored, these toners may, in embodiments, become visible or have a different image become visible using light of a suitable wavelength, in embodiments ultraviolet (UV) light of a predetermined wavelength. This visibility may be imparted to the toner by the addition of a fluorescent agent or additive, referred to herein, in embodiments, as a light emitter and/or a fluorescent agent, which may be a material that only becomes visible upon exposure to UV light. In embodiments, a fluorescent agent may be an emitting component or a component that fluoresces when exposed to UV light of a wavelength of from about 10 nanometers to about 400 nanometers, in embodiments from about 200 nanometers to about 395 nanometers of the UV spectral region.

In embodiments, suitable fluorescent agents include, for example, 4,4'-bis(styryl)biphenyl,2-(4-phenylstilben-4-yl)-6-butylbenzoxazole, 2-(2-hydroxyphenyl)benzothiazole, β-methyl umbelliferone, 4-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl)naphthacene, DAYGLO INVISIBLE BLUE™ A-594-5, combinations thereof, and the like. Other suitable fluorescent agents include, for example, 9,10-diphenyl anthracene and its derivatives, N-salicylidene-4-dimethylaminoaniline, 2-(2-hydroxyphenyl)benzimidazole, 2-(2-hydroxyphenyl)benzoxazole, combinations thereof, and the like.

Still, other suitable fluorescent agents further include lanthanide coordination complexes. Lanthanide complexes for use as invisible fluorescent agents may be prepared from any of the lanthanide elements. In embodiments, the fluorescent agent may be prepared from praseodymium, neodymium, samarium, europium, gadolinium, terbium, dysprosium, holmium, erbium, thulium and ytterbium. In practice, lanthanide ions do not absorb exciting light efficiently. Combining the lanthanide ions with a ligand, in embodiments an organic ligand, may allow the resulting complex to absorb light and transfer energy to the lanthanide ions. The lanthanide complexes of the present disclosure thus appear colorless under normal light but undergo energy transfer when bound to lanthanide ions, leading to fluorescence at a wavelength widely separated from that of the absorbed light.

Various types of organic ligands can be used to form suitable lanthanide complexes, such as bis(pyrazolyl)pyridine, tris(2,2,6,6,-tetramethyl-3,5-heptanedionato) chelate, tris(2,2,6,6,-tetrakis(trifluoromethyl)-3,5-heptanedionato) chelate, combinations thereof, and the like. Examples of suitable methods for forming lanthanide complexes include those disclosed in U.S. Pat. No. 5,435,937, the disclosure of which is hereby incorporated by reference in its entirety.

Specific examples of suitable lanthanide complexes include DFKY-C7 and DFSB C7 lanthanide fluorescent agents, commercially available from Risk Reactor, Huntington Beach, Calif.

In embodiments, the fluorescent agent may be added to a resin as described above, optionally in a dispersion including a surfactant described above. The fluorescent agent may be added to the resin utilized to form a toner composition described above utilizing any method within the purview of those skilled in the art including, but not limited to, for example, mixing, blending, combinations thereof, and the like. The combination of fluorescent agent and resin may then be utilized to form a toner.

The fluorescent agent may be present in a toner of the present disclosure in an amount of from about 0.1% by weight of the toner to about 20% by weight of the toner, in embodiments from about 2% by weight of the toner to about 6% by weight of the toner.

The fluorescence of a toner possessing a fluorescent agent in accordance with the present disclosure can thus be tuned so that it appears upon exposure to UV light at a wavelength of from about 400 nm to about 800 nm, in embodiments from about 450 nm to about 750 nm, by using different fluorescent agents. Optional security levels may be designed based upon the selection and use of differeing fluorescent agents and their emission of light at different wavelengths.

Colorants

As noted above, in embodiments, fluorescent toners of the present disclosure may be utilized in addition to colored toners utilized for full color printing, or fluorescent pigments may be combined into one or more of the colored toners, to produce full color images that reveal additional fluorescent features and/or different fluorescent color images under UV light. For example, a fluorescent toner of the present disclosure can include other pigments, so that the toner has one color under normal illumination and a different color upon exposure to UV light.

Where colored toners are utilized, the colorant may be in a dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. Suitable surfactants include any of those surfactants described above. In embodiments, the surfactant may be ionic and may be present in a dispersion in an amount from about 0.1 to about 25 percent by weight of the colorant, and in embodiments from about 1 to about 15 percent by weight of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or mixtures thereof.

In embodiments wherein the colorant is a pigment, the pigment may be, for example, carbon black, phthalocyanines, quinacridones or RHODAMINE B™ type, red, green, orange, brown, violet, yellow, fluorescent colorants, and the like.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as CI 60710, CI Dispersed Red 15, diazo dye identified in the Color Index as CI 26050, CI Solvent Red 19, copper tetra(octadecyl sulfonamido)phthalocyanine, x-copper phthalocyanine pigment listed in the Color Index as CI 74160, CI Pigment Blue, Anthrathrene Blue identified in the Color Index as CI 69810, Special Blue X-2137, diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight of the toner, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant.

Wax

Optionally, a wax may also be combined with the resin and fluorescent agent in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 535™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion (s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a COULTER COUNTER, for average particle size. The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Shell Resin

In embodiments, an optional shell may be applied to the formed aggregated toner particles. Any resin described above as suitable for the core resin may be utilized as the shell resin. The shell resin may be applied to the aggregated particles by any method within the purview of those skilled in the art. In embodiments, the shell resin may be in an emulsion including any surfactant described above. The aggregated particles described above may be combined with said emulsion so that the resin forms a shell over the formed aggregates. In embodiments, an amorphous polyester may be utilized to form a shell over the aggregates to form toner particles having a core-shell configuration.

Once the desired final size of the toner particles is achieved, the pH of the mixture may be adjusted with a base to a value of from about 6 to about 10, and in embodiments from about 6.2 to about 7. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above. The base may be added in amounts from about 2 to about 25 percent by weight of the mixture, in embodiments from about 4 to about 10 percent by weight of the mixture.

Coalescence

Following aggregation to the desired particle size, with the formation of an optional shell as described above, the particles may then be coalesced to the desired final shape, the coalescence being achieved by, for example, heating the mixture to a temperature of from about 55° C. to about 100° C., in embodiments from about 65° C. to about 75° C., in embodiments about 70° C., which may be below the melting point of the crystalline resin to prevent plasticization. Higher or lower temperatures may be used, it being understood that the temperature is a function of the resins used for the binder.

Coalescence may proceed and be accomplished over a period of from about 0.1 to about 9 hours, in embodiments from about 0.5 to about 4 hours.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Hodogaya Chemical); combinations thereof, and the like. Such charge control agents may be applied simultaneously with the shell resin described above or after application of the shell resin.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, and 6,214,507, the disclosures of each of which are hereby incorporated by reference in their entirety. Again, these additives may be applied simultaneously with a shell resin described above or after application of the shell resin.

In embodiments, toners of the present disclosure may be utilized as ultra low melt (ULM) toners. In embodiments, the dry toner particles, exclusive of external surface additives, may have the following characteristics:

(1) Volume average diameter (also referred to as "volume average particle diameter") of from about 3 to about 20 μm, in embodiments from about 4 to about 15 μm, in other embodiments from about 5 to about 9 μm.

(2) Number Average Geometric Standard Deviation (GSDn) and/or Volume Average Geometric Standard Deviation (GSDv) of from about 1.05 to about 1.55, in embodiments from about 1.1 to about 1.4.

(3) Circularity of from about 0.9 to about 1 (measured with, for example, a Sysmex FPIA 2100 analyzer), in embodiments form about 0.95 to about 0.985, in other embodiments from about 0.96 to about 0.98.

(4) Glass transition temperature of from about 40° C. to about 65° C., in embodiments from about 55° C. to about 62° C.

The characteristics of the toner particles may be determined by any suitable technique and apparatus. Volume average particle diameter $D_{50v}$, GSDv, and GSDn may be measured by means of a measuring instrument such as a Beckman Coulter MULTISIZER 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter MULTISIZER 3. Toners produced in accordance with the present disclosure may possess excellent charging characteristics when exposed to extreme relative humidity (RH) conditions. The low-humidity zone (C zone) may be about 10° C./15% RH, while the high humidity zone (A zone) may be about 28° C./85% RH. Toners of the present disclosure may also possess a parent toner charge per mass ratio (Q/m) of from about −3 μC/gram to about −90 μC/gram, in embodiments from about −10 μC/gram to about −80 μC/gram, and a final toner charging after surface additive blending of from −10 μC/gram to about −70 μC/gram, in embodiments from about −15 μC/gram to about −60 μC/gram.

In some cases an ionic crosslinker may be added to the toner compositions to further adjust the desired gloss of the toner compositions. Such ionic crosslinkers include, for example, $Al^{3+}$ crosslinkers, including aluminum sulfate ($Al_2(SO_4)_3$), polyaluminum chloride, polyaluminum sulfosilicate, and combinations thereof. The degree of ionic crosslinking may be influenced by the amount of retained metal ion, such as $Al^{3+}$, in the particle. The amount of retained metal ion may be further adjusted by the addition of EDTA in the formulation as described above. In embodiments, the amount of retained crosslinker, for example $Al^{3+}$, in toner particles of the present disclosure may be from about 50 parts per million (ppm) to about 1000 ppm, in other embodiments from about 500 ppm to about 800 ppm.

The resulting toners may be, in embodiments, a clear toner having a low and tunable gloss level, which contains light emitting materials in the UV range. Utilizing the materials and methods of the present disclosure, one can thus produce invisible prints by matching the gloss level of the toner with the substrate to which the toner is to be applied. Thus, for example, the gloss level of a toner of the present disclosure may be adjusted from matte to gloss on paper, having a gloss as measured by Gardner Gloss Units (ggu) of from about 5 ggu to about 90 ggu, in embodiments from about 15 ggu to about 80 ggu.

Thus, in embodiments, an electrophotographic image produced with a toner of the present disclosure may be invisible and have substantially no differential gloss between the toner and paper to which it is applied when exposed to visible light, but the toner becomes visible when exposed to UV light as described above. In embodiments, images produced with toners of the present disclosure become visible when exposed to light at wavelengths of from about 200 nm to about 400 nm, in embodiments from about 250 nm to about 375 nm. As used herein, "no differential gloss" may mean that the difference in gloss units between the paper and the toner may be less than about 15 ggu, in embodiments less than about 10 ggu, in other embodiments less than about 5 ggu.

One advantage of toners of the present disclosure, which may be used to prepare invisible watermarks, which differs from the use of inkjet printers, includes the simplified design of the electrophotographic machine and the ability to apply the toners of the present disclosure with such an electrophotographic machine.

Developers

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic or electrophotographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In accordance with the present disclosure, more than one toner possessing a fluorescent agent may be applied to a substrate. Upon exposure to light of an appropriate wavelength, the toner may emit colored light that may be red, green, blue, or combinations thereof. In embodiments, multiple toners may be applied to a substrate, with each toner emitting a different colored light. By varying the combination of toners and amounts of toner applied, one could thus produce an image that may emit any desired color upon illumination by UV light. The toner itself could be clear under natural light, or may include any colorant described above, including cyan, magenta, yellow, and/or black (CMYK).

In embodiments, appropriate amounts of toner to be applied to a substrate may be adjusted by altering the toner mass per unit area (TMA) applied to a substrate, or halftoning. Where TMA is utilized to adjust the amount of toner applied to a substrate and thus form an image according to the present disclosure, varying amounts of different color toners may be utilized. By varying the amounts of toner utilized and the TMA for different toners emitting red, green, and/or blue, including combinations thereof, one could produce an image on a substrate that emits any desired color upon exposure to UV light.

In embodiments, various combinations of toners emitting red upon exposure to UV light, toners emitting green upon exposure to UV light, and toners emitting blue upon exposure to UV light may be utilized to form an image in accordance with the present disclosure. In such a case, in embodiments, the TMA for the toner emitting red may be from about 0 $mg/cm^2$ to about 1.5 $mg/cm^2$, in embodiments from about 0.1 $mg/cm^2$ to about 0.75 $mg/cm^2$; the TMA for the toner emitting green may be from about 0 $mg/cm^2$ to about 1.5 $mg/cm^2$, in embodiments from about 0.1 $mg/cm^2$ to about 0.75 $mg/cm^2$; and for the toner emitting blue the TMA may be from about 0 $mg/cm^2$ to about 1.5 $mg/cm^2$, in embodiments from about 0.1 $mg/cm^2$ to about 0.75 $mg/cm^2$. In embodiments, various combinations of toners may include a first toner and at least one additional toner, where the at least one additional toner comprises from 1 to about 5 toners.

As noted above, in other embodiments halftoning may be utilized to determine the types and amounts of toners utilized to form a desired color upon exposure to UV light. Halftoning involves taking a source image (sometimes referred to herein as a "continuous-tone image" or "contone image") which contains a certain amount of tone information and converting it to a target image with less tone information.

For color printing, most digital color printers operate in a binary mode, i.e., for each color separation, a corresponding color spot is either printed or not printed at a specified location or pixel. Digital halftoning controls the printing of color spots, where spatially averaging the printed color spots of all the color separations provides the illusion of the required continuous color tones.

A common halftone technique is screening, which compares the required continuous color tone level of each pixel for each color separation with one of several predetermined threshold levels. The predetermined threshold levels are stored in a halftone screen. If the required color tone level is darker than the threshold halftone level, a color spot is printed at the specified pixel. Otherwise the color spot is not printed. The distribution of printed pixels depends on the design of the halftone screen. For cluster halftone screens, printed pixels are grouped into one or more clusters. If a cluster-halftone screen only generates a single cluster, it is referred to as a single-cell halftone screen or a single-cell halftone dot. Alternatively, halftone screens may be dual-dot, tri-dot, quad-dot, or the like.

Halftone screens are often two-dimensional threshold arrays and are relatively small in comparison to the overall image or document to be printed. Therefore, the screening process may use an identical halftone screen repeated for each color separation. The output of the screening process, using a single-cell halftone dot, includes a binary pattern of multiple small "dots", which are regularly spaced and is determined by the size and the shape of the halftone screen. In other words, the screening output, as a two-dimensionally repeated pattern, possesses two fundamental spatial frequencies, which are completely defined by the geometry of the halftone screen.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 30° C.

EXAMPLES

Example 1

A clear ultra low melt (ULM) fluorescent latex, emitting green light under UV, was prepared as follows. An organic solution was prepared by heating and mixing at 50° C. the following components: about 120 grams of an alkoxylated Bisphenol A fumarate/terephthalate resin (amorphous core component), about 10 grams of 2-(2-hydroxyphenyl)benzothiazole (invisible green fluorescent dye) in about 1 kilogram of ethyl acetate solvent. A second solution was prepared by mixing about 2.5 grams of DOWFAX™ 2A1 (an alkyldiphenyloxide disulfonate from The Dow Chemical Company used as a dispersant) in about 850 grams of distilled water. This solution was warmed at 50° C. This water solution was placed in a 4 liter kettle and about 2.5 grams of $NH_4OH$ concentrated were added. The water solution was homogenized while slowly adding the organic solution thereto by mixing at a speed of about 6000 rpm, and increasing the speed of mixing to about 24000 rpm. As the viscosity increased, the speed of the homogenizer was increased from low to highest (at the end of the addition). After completing the addition, the mixture was homogenized for an additional 30 minutes at about 24000 rpm.

A distillation column was added to the kettle and the organic solvent was distilled away. The lid was removed and the solution was left stirring overnight at room temperature. Finally, the emulsion was filtered through a 25 μm sieve. The emulsion had an average particle size of $d_{50V}$=174 nm and the solids contents was 21.7%. It emitted bright green light when exposed to UV light.

Examples 2-5

Additional latexes were prepared as described in Example 1, with differing pigments. The general procedures and amounts from Example 1 were utilized. These examples also illustrated the ability to control the particle size of the latex by changing the amount of DOWFAX™ 2A1 surfactant. The emitted colors were red, green and blue. All latexes prepared had a white milky appearance under normal light and emitted the described colors under exposure to UV light. Table 1 below summarizes the colored toners produced.

TABLE 1

| Example # | Emitted color | Dye | DOWFAX ™ 2A1 | Solid % | D50V |
|---|---|---|---|---|---|
| 2 | Blue | DFSB-C0 | 1.5 grams | 19.42% | 267 nm |
| 3 | Blue | DFSB-C0 | 2.5 grams | TBD | 214 nm |
| 4 | Red | DFKY-C7 | 2.5 grams | 17.49% | 175 nm |
| 5 | Green | Dye | 2.5 grams | | 158 nm |

The invisible blue emitting fluorescent dye (DFSB-C0) from this experiment was an organic fluorescent dye, soluble in common organic solvents like ethyl acetate, obtained from Risk Reactor, Huntington Beach, Calif. The invisible red emitting dye (DKFY-C7), a lanthanide coordination complex, was purchased from Risk Reactor, Huntington Beach, Calif. The invisible green dye used in example #5 was 2-(2-hydroxyphenyl)benzothiazole, commercially available from Sigma Aldrich.

Example 6

A low gloss, clear ULM EA toner, emitting blue light under UV light, was produced as follows. A 4 liter kettle was filled with about 137.1 grams of a high molecular weight alkoxylated bisphenol A fumarate/terephthalate resin, about 303.1 grams of the clear/blue ULM fluorescent emulsion from Example 2, about 46.5 grams of poly(nonylene doedecanedioate) crystalline polyester latex, about 61.2 grams of a polymethylene wax latex, about 648 grams of distilled water, and about 4.41 grams of DOWFAXTM 2A1 surfactant. The pH was adjusted to about 4.2. The solution was homogenized at about 6000 rpm and an aluminum sulfate solution was added dropwise. The speed of mixing was slowly increased to about 10000 rpm as the viscosity of the mixture increased. At the end of the addition, the mixture was homogenized at about 10000 rpm for an additional 3 minutes.

The kettle was heated to a temperature of about 33° C. under continuous stirring at a speed of about 350 rpm. The temperature was slowly raised to about 45° C. until the particle size of the toner was about 5.3 μm.

A composition was then formed by slowly adding the following to the toner particles: about 71.2 grams of a first alkoxylated bisphenol A funmarate/terephthalate amorphous latex, about 79.8 grams of second alkoxylated bisphenol A funmarate/terephthalate amorphous latex, about 2.4 grams of DOWFAX™ 2A1 surfactant, and about 73 grams of distilled water. When the particle size was about 5.8 μm, the pH was adjusted to about 8 and the temperature was raised to about 85° C., until a circularity of about 0.964 was achieved for the particles. The toner mixture was poured over cold ice and stirred overnight. The toner was washed with a sequence of diluted acid and base solutions, filtered and freeze dried to provide a toner with a prarticle size of $d_{50V}$=6.14 μm.

Example 6a

Example 7

A low gloss, clear ULM EA toner, emitting green light under UV light, was produced following the procedure from Example 6, except a green emitting latex (from Example 1) was used to provide a toner with a particle size of $d_{50V}$=9.3 μm.

Example 8

A high gloss clear ULM EA toner emitting blue light was produced as follows. The procedure from Example 6 was followed with the emulsion from Example 2 and about 4.6 grams of an EDTA chelating agent (VERSENE solution) to provide a pH of about 8 and freeze particle growth. This provided a clear toner emitting blue light under UV, with a particle size of $D_{50V}$=6.1 μm and a circularity of 0.964.

Example 9

A high gloss clear ULM EA toner emitting green light was produced as follows. The procedure from Example 6 was used with the emulsion from Example 1 and with about 4.6 grams of an EDTA chelating agent (VERSENE solution) to provide a pH of about 8 and freeze particle growth. This provided a clear toner emitting green light under UV, with a particle size of $D_{50V}$=6.1 μ.m and a circularity of 0.973.

Example 10

Toner Charging. Toner samples were blended on a sample mill for about 30 seconds at about 15000 rpm. Developer samples were prepared with about 0.5 grams of a toner sample and about 10 grams of Xerox 700 DCP production carrier. A separate additive design with a low silica/titania ratio was utilized as a control. The additive package used as the control included:

about 1.08% of a silica surface treated with polydimethylsiloxane, commercially available as RY50 from Evonik (Nippon Aerosil);

about 0.72% of a silica surface treated with hexamethyldisilazane, commercially available as RX50 from Evonik (Nippon Aerosil);

about 1.2% of a titanium surface treated with butyltrimethoxysiliane, commercially available as STT100H available from Titan Koygo;

about 1.73% of a sol-gel silica surface treated with hexamethyldisilazane, commercially available as X24-9163A from Nisshin Chemical Kogyo;

about 0.28% of a cerium dioxide, commercially available as EI 0 from Mitsui Mining & Smelting; and about 0.15% of zinc stearate.

A duplicate developer sample pair was prepared for each toner. One developer of the pair was conditioned overnight in A-zone (28° C./85% RH), and the other was conditioned overnight in the C-zone environmental chamber (10° C./15% RH).

The next day, the developer samples were sealed and agitated for about 2 minutes and then about 1 hour using a TURBULA mixer. After mixing, the toner triboelectric charge was measured using a charge spectrograph using a 100 V/cm field. The toner charge (q/d) was measured visually as the midpoint of the toner charge distribution. The charge was reported in millimeters of displacement from the zero line. The value in mm displacement can be converted to a value in femtocoulombs/micron by multiplying by 0.092.

Following mixing, an additional 0.5 grams of toner sample was added to the already charged developer, and mixed for a further 15 seconds, where a q/d displacement was again measured, and then mixed for a further 45 seconds (total 1 minute of additional mixing), and again a q/d displacement was measured.

Figure 2:
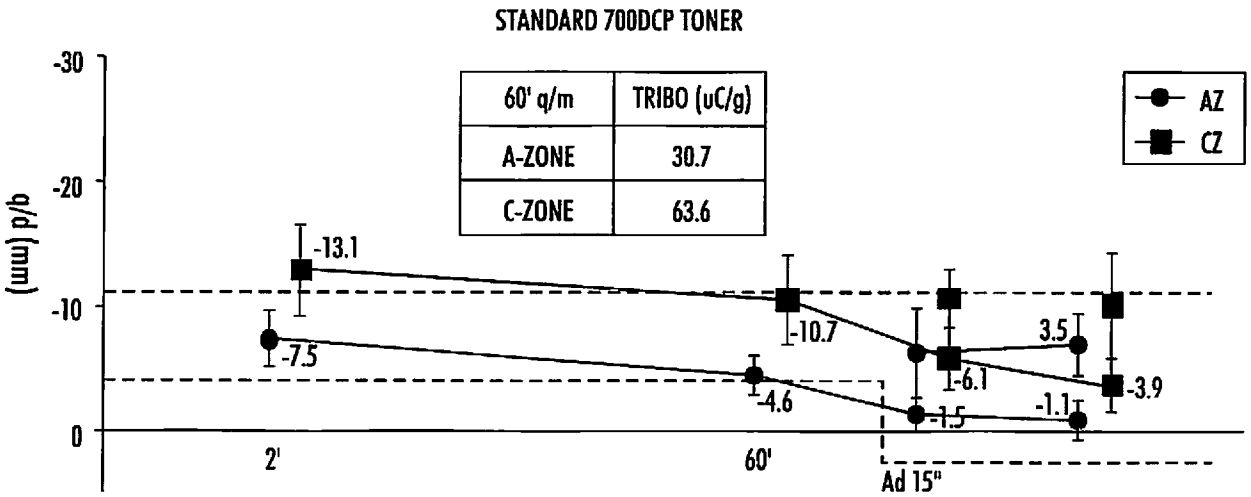
FIG. 2 is a graph showing charge characteristics of a control toner in both A-zone and C-zone.

The same charging measurements were obtained for a standard Xerox 700 DCP toner used as a control. FIGS. 1 and 2 include the results of the charging. FIG. 1 has the charging properties of the clear blue fluorescent toner from Example 8, with FIG. 2 having the charging properties of the control toner.

All toner charge levels and charge distribution widths (indicated by "error" bars) were good with improved RH sensitivity observed over the control. Charge levels in A-zone were higher than the control, which is desirable. C-zone charge was slightly higher than the desired range of −4 to −11 mm displacement. Admix showed no wrong sign toner even given that 5% toner concentration (TC) with additional 5% for admix was considered a stress test.

Example 11

Machine tests and pictures of prints under normal and UV light. About 230 grams of developer was prepared at about 12% TC and blended in a TURBULA mixer for about 10 minutes. A Xerox WCP3545 machine was used to generate prints. Electrostatic settings were set to nominal and LD power was adjusted to obtain a target toner mass per unit area (TMA) of 0.45 mg/cm$^2$. Toner charge per mass ratio (Q/m) and development curves were also measured during the test. The green fluorescent toner of Example 6 had a Q/m value of −29.3 μC/gram and the blue fluorescent toner of Example 8 had a Q/m value of −37.17 μC/gram.

The prints included several details, including several logos, 1D and 2D barcodes, solid and halftone patches, and text. There were no issues obtaining proper transfer, and development was well within the machine's range. Machine fusing showed some offset due to high fuser temperature. Unfused prints were generated and later fused in an offline fixture at a lower temperature.

Example 12

Gloss Control. Prints made with clear blue emitting toners were made and gloss difference was measured by using a BYK Gardner micro gloss meter. Samples were fused at a temperature of about 150° C. Data shown in Table 2 below clearly demonstrates that samples made with EDTA (VERSENE solution) in the freezing step had a significantly higher gloss difference when compared with samples made with no EDTA (VERSENE solution). This demonstrates the gloss of the clear fluorescent ULM EA toner could be controlled by changing the amount of EDTA in the freezing step.

The amount of EDTA could be changed in such a way that any gloss difference in the range shown in Table 2 below could be obtained.

TABLE 2

| Toner | Type | Gloss (ggu) Substrate | Toner Print | Difference |
|---|---|---|---|---|
| Example 6 | Low Gloss (No EDTA) | 10.4 | 13.3 | 2.9 |
| Example 8 | High Gloss (EDTA) | 7.8 | 28.8 | 21.0 |

Example 13

Additional developer samples were prepared following the procedures of Example 10, utilizing a different surface additive package. The additive package used included:

about 0.88% of titanium dioxide treated with a decylsilane, commercially available as JMT2000 from Tayca;

about 1.71% of a silica surface treated with polydimethylsiloxane, commercially available as RY50 from Evonik (from Nippon Aerosil);

about 1.73% of a sol-gel silica surface treated with hexamethyldisilazane, commercially available as X24-9163A from Nisshin Chemical Kogyo;

about 0.55% of a cerium dioxide, commercially available as E10 from Mitsui Mining & Smelting; and about 0.2% of zinc stearate.

For each developer composition, about 40 grams of toner from Examples 8-9, and toner prepared with the emulsion from Example 4, was mixed with about 400 grams of carrier. The developers were placed in developer housings of a XEROX DC250 electrophotographic machine, instead of the standard cyan, magenta, yellow, and black (CMYK) colors. In order to effectively see the fluorescence of the toner, papers utilized as the substrate to which the toner was applied were chosen that did not contain brighteners (fluorescent additives that are present in most commercially available white papers). A blue paper was utilized that was readily available, but the actual color of the paper was not important.

The primary colors, i.e. the toners that fluoresced red, green and blue (RGB), were first printed without any mixing, with each toner printed from a different housing, and the intensity of the fluorescence was adjusted by adjusting toner mass per unit area (TMA) and halftoning. The intensity was simply estimated without instrumentation and adjusted to be similar for the colors. The fluorescence of the blue toner was significantly higher than the red and the green toners; therefore the TMA of the blue toner had to be reduced by approximately a factor of 10. The final TMA used were: Red=0.59 mg/cm$^2$ using 100% patch, Green=0.37 mg/cm$^2$ using 100% patch and Blue=0.071 mg/cm$^2$ using 40% patch. The primary RGB colors were compared with a mixture of all three colors under normal room lights, under UV and room light, and under UV light only. Because the spectrum and intensity of the primary colors were not optimized, the mixture of the three did not produce a pure white light upon exposure to UV. However, the resulting color for the mixture was clearly whiter and brighter than the primaries.

To demonstrate the potential gamut of colors visible under UV light, each pair of primaries was printed in a matrix by varying the density of halftone screen of each color. The results demonstrated that a wide range of colors could be produced upon exposure to UV light, including yellow, orange, and purple.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process comprising:

forming a first toner comprising at least one amorphous resin and at least one crystalline resin, an optional colorant, and an optional wax with at least one lanthanide coordination complex capable of emitting light on exposure to ultraviolet light at a wavelength of from about 10 nm to about 400 nm;

forming at least one additional toner comprising at least one amorphous resin and at least one crystalline resin, an optional colorant, and an optional wax with at least one organic fluorescent agent capable of emitting light on exposure to ultraviolet light at a wavelength of from about 10 nm to about 400 nm;

applying said first toner and the at least one additional toner to a substrate; and exposing the first toner and the at least one additional toner to light at a wavelength of from about 10 nm to about 400 nm, wherein exposing the first toner and the at least one additional toner to light at a wavelength of from about 10 nm to about 400 nm causes said first toner to emit a first color and the at least one additional toner to emit a color different from the first color, wherein the amounts of the first toner and the at least one additional toner applied to the substrate are adjusted to produce a desired color on exposure to light at a wavelength of from about 10 nm to about 400 nm, and wherein the amounts of the first toner and the at least one additional toner applied to the substrate are adjusted based on toner mass per unit area and halftoning.

2. The process of claim 1, wherein the first toner, the at least one additional toner, or both, further comprise a colorant selected from the group consisting of cyan, magenta, yellow and black.

3. The process of claim 1, wherein the first toner emits light comprising a color selected from the group consisting of red, green, blue, and combinations thereof.

4. The process of claim 1, wherein the at least one additional toner emits light selected from the group consisting of red, green, blue, and combinations thereof.

5. The process of claim 1, wherein the lanthanide coordination complex of the first toner is present in an amount of from about 0.1% by weight of the toner to about 20% by weight of the toner.

6. The process of claim 1, wherein the at least one organic fluorescent agent capable of emitting light on exposure to ultraviolet light is selected from the group consisting of 4,4'-bis(styryl)biphenyl,2-(4-phenylstilben-4-yl)-6-butylbenzoxazole, 2-(2-hydroxyphenyl)benzothiazole, β-methyl umbelliferone, 4-methyl-7-dimethylaminocoumarin, 4-methyl-7-aminocoumarin, N-methyl-4-methoxy-1,8-naphthalimide, 9,10-bis(phenethynyl)anthracene, 5,12-bis(phenethynyl)

naphthacene, 9,10-diphenyl anthracene, N-salicylidene-4-dimethylaminoardline, 2(2-hydroxyphenyl)benzimidazole, 2-(2-hydroxyphenyl)benzoxazole, and combinations thereof.

7. The process of claim 1, wherein the at least one additional toner comprises from 1 to about 5 toners.

8. The process of claim 1, wherein the at least one organic fluorescent agent capable of emitting light on exposure to ultraviolet light of the at least one additional toner is present in an amount of from about 0.1% by weight of the toner to about 20% by weight of the toner.

9. A process comprising:

forming a first toner comprising at least one amorphous resin and at least one crystalline resin, an optional colorant, and an optional wax with at least one lanthanide coordination complex capable of emitting a red color on exposure to ultraviolet light at a wavelength of from about 10 nm to about 400 nm;

forming a second toner comprising at least one amorphous resin and at least one crystalline resin, an optional colorant, and an optional wax with at least one organic fluorescent agent capable of emitting a green color on exposure to ultraviolet light at a wavelength of from about 10 nm to about 400 nm;

forming a third toner comprising at least one amorphous resin and at least one crystalline resin, an optional colorant, and an optional wax with at least one organic fluorescent agent capable of emitting a blue color on exposure to ultraviolet light at a wavelength of from about 10 nm to about 400 nm;

applying said first toner, the second toner and the third toner to a substrate; and exposing the first toner, the second toner and the third toner to light at a wavelength of from about 10 nm to about 400 nm, wherein exposing the first toner, the second toner and the third toner to light at a wavelength of from about 10 nm to about 400 nm causes said first toner to emit a red color, the second toner to emit a green color, and the third toner to emit a blue color, wherein the amounts of the first toner, the second toner, and the third toner applied to the substrate are adjusted to produce a desired color on exposure to light at a wavelength of from about 10 nm to about 400 nm, and wherein the amounts of the first toner, the second toner, and the third toner applied to the substrate are adjusted based on toner mass per unit area and halftoning.

10. The process of claim 9, wherein the first toner, the second toner, or the third toner further comprise a colorant selected from the group consisting of cyan, magenta, yellow and black.

11. The process of claim 9, wherein the toner mass per unit area for the first toner emitting red is from about 0.1 $mg/cm^2$ to about 0.75 $mg/cm^2$, the toner mass per unit area for the second toner emitting green is from about 0.1 $mg/cm^2$ to about 0.75 $mg/cm^2$, and the toner mass per unit area for the third toner emitting blue is from about 0.1 $mg/cm^2$ to about 0.75 $mg/cm^2$.

* * * * *